United States Patent [19]

George

[11] 4,212,576

[45] Jul. 15, 1980

[54] PIPE HANDLING APPARATUS

[76] Inventor: Albert L. George, P.O. Box 3604, Lafayette, La. 70501

[21] Appl. No.: 882,656

[22] Filed: Mar. 2, 1978

[51] Int. Cl.[2] ..... E21B 19/14

[52] U.S. Cl. ..... 414/22; 104/112; 104/180; 242/47.01; 254/332

[58] Field of Search ..... 214/1 P, 2.5; 104/112, 104/117, 180, 183, 114; 254/172, 147, 175.3, 186 R; 175/52, 85; 414/22, 745; 242/47.01, 47.09, 47.11

[56] References Cited

U.S. PATENT DOCUMENTS

| | | | |
|---|---|---|---|
| 3,437,315 | 4/1969 | McDonald | 212/76 X |
| 3,589,299 | 6/1971 | Ingram | 214/13 X |
| 3,713,547 | 1/1973 | Beck | 214/2.5 |
| 3,713,548 | 1/1973 | Hanke | 214/13 |
| 3,720,400 | 3/1973 | Potts | 254/172 |
| 3,749,367 | 7/1973 | Joubert | 254/172 X |
| 4,053,063 | 10/1977 | Harper | 214/2.5 |
| 4,081,087 | 3/1978 | Freeman | 214/2.5 |

*Primary Examiner*—L. J. Paperner

*Attorney, Agent, or Firm*—Pravel, Gambrell, Hewitt, Kirk, Kimball & Dodge

[57] ABSTRACT

A pipe handling apparatus for lifting and/or lowering heavy objects such as drill pipe, drill collars and the like to and from the elevated floor of a drilling rig from a lower storage position including an endless loop cable rove in a single layer in wide spaced grooves on a pivotably mounted rotatable drum and a deep, wide grooved sheave mounted substantially vertically on a load aligning floor pole with means for pivoting the rotatable drum to slacken or tension the cable to vary the elevation of the object being carried on free running trolly means and means for automatically preventing overloading of the cable.

7 Claims, 7 Drawing Figures

C
R
R
25
24
22
42
43
40a
33
34
40
36
B
22
39
19
39a
38a
21
18
18a
20
38
44
50
45
15
I
H
17
14

PIPE HANDLING APPARATUS

BACKGROUND OF THE INVENTION

As oil and gas wells are drilled to greater depths it becomes necessary to provide larger and more complicated blowout preventers and other protective devices on the well and as a result, the floor of the drilling rig has been elevated to greater heights above the ground and more particularly above horizontal pipe racks or other storage facilities on the ground or platform on which drill pipe, drill collars, casings, the tubing, and the like, are normally stored. Such pipe racks are normally parallel to the cat walk and vertically lower than the drilling rig floor. During the drilling operation it is necessary to move successive units of pipe from the horizontal pipe racks into a vertical position in the derrick. The drill pipe, tubing, and the like, are connected together end-to-end by means of threaded connections. The threaded areas and adjacent seal surfaces on the pipe must be protected from damage during handling in moving the pipe back and forth from the drill rig to the pipe rack.

SUMMARY OF THE INVENTION

The present invention provides a new and improved pipe handling apparatus including an endless cable loop carried on a sheave that is pivotally mounted near the elevated floor of a drilling rig and on a horizontally disposed drum near the rack on which the pipe is stored. The drum is provided with a continuous helical groove to accommodate the cable in spaced apart wraps without scraping or rubbing as it is wound onto and off of the drum. Also, the drum has sufficient diameter and length to carry enough cable to extend from the drum to the pivotally mounted sheave at the derrick floor and back to the drum to enable a full trip to be made in one direction between sheave and drum without the cable on the drum being wrapped so as to overlap itself. Also, the drum is provided with hydraulic drive and speed controls for controlling the rate at which the drum is rotated. The hydraulic cylinders for pivoting the drum to slacken and/or tighten the cable are provided with load sensing devices and an overload release apparatus to prevent overloading the cable.

The single sheave which is mounted at the derrick floor for receiving the endless cable has a deep, wide groove and is mounted for rotation on a horizontal axis which in turn is mounted for pivotal movement about a vertical axis to enable the sheave to automatically align with the load that is applied by the cable so as to reduce scraping of the cable.

The endless cable is provided with means for connecting or gripping a joint of pipe including a fall-away hook with soft covering which will automatically disengage the pipe. Thus, the present invention provides a new and improved means for handling pipe or other heavy objects in moving them to and from the elevated floor of a drilling rig, including means for controlling acceleration and deceleration of these heavy objects. Also, the apparatus of the present invention provides a portable pipe handling apparatus which can be economically manufactured and quickly and easily rigged up and rigged down and which includes control features to facilitate safe operation by semi-skilled operators.

DESCRIPTION OF THE PREFERRED EMBODIMENT

Figure 1:
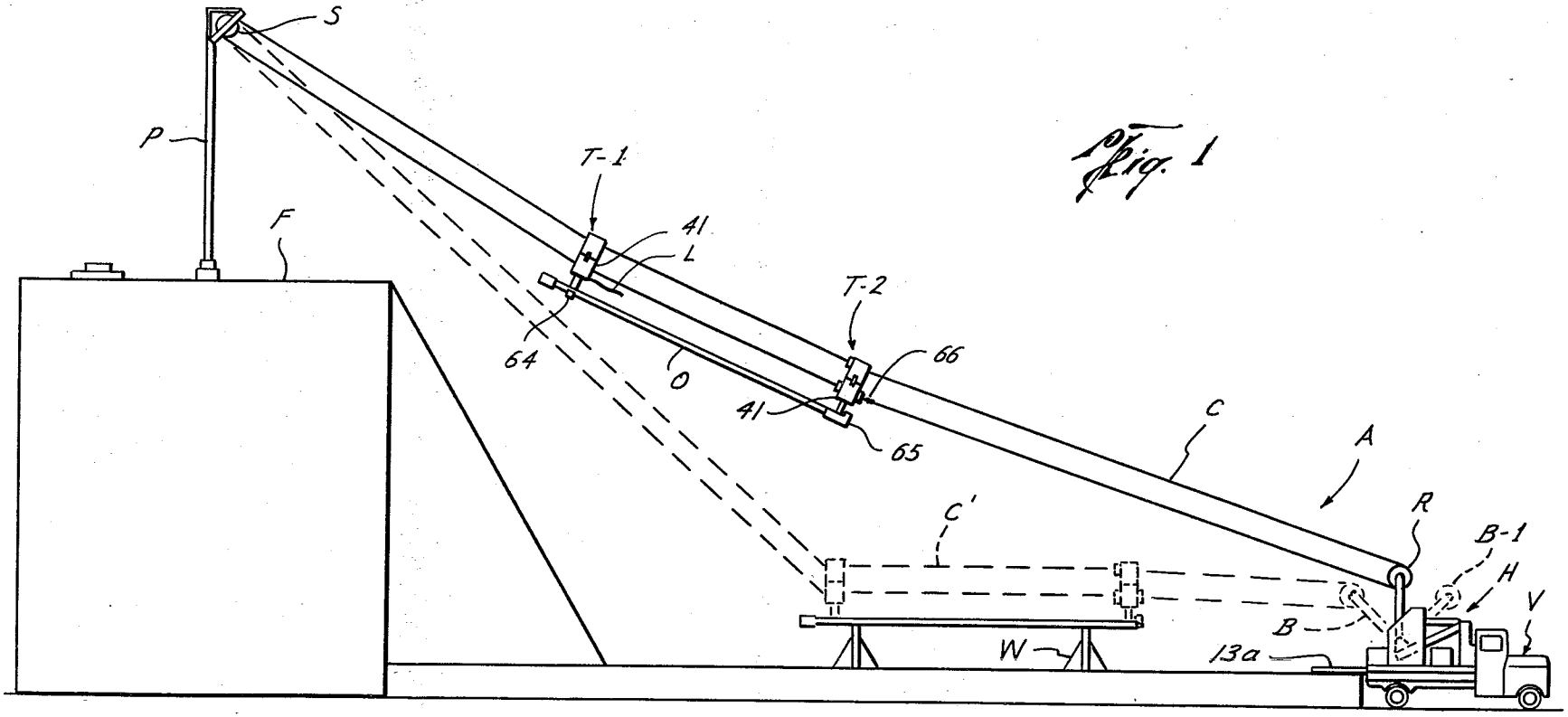
FIG. 1 is a side elevation showing the portable pipe handling apparatus rigged up at a drilling rig.

As shown in FIG. 1 of the drawings, the pipe handling apparatus of the present invention is designated generally A. Such apparatus includes a skid mounted power unit H which is shown removably secured to a truck or vehicle V and which includes a cable C which extends from the reel R upwardly to the sheave S mounted on the pole P that is positioned above the rig floor F. The reel or drum R is mounted on a hydraulically actuated boom B which pivots the drum to tension or slacken the cable C and permit it to fall to the position adjacent the pipe rack W as shown by the dotted lines C' for loading or unloading an object or joint of pipe or to tension to cable C to hold it taut as indicated by the solid line. A pipe or other object O is moved by the cable C by means of the trollies indicated generally T.

The trollies T, which carry the pipe or other object O, are moved by rotating the reel R which roves the cable C onto and off of the reel R as will be described in more detail hereinafter. It will be appreciated that the tension in the cable is produced by the load imposed by the travelling blocks or trollies T and is also a function of the angle formed by the tension cable and the two points of suspension, one being the reel R and the other being at the sheave S mounted on the pole P. As this angle approaches 180°, the force in the cable created by a given load on the trollies approaches infinity. For this reason, it is important to be able to measure the amount of tension in the cable C and to be able to control this tension within safe limits. As will be described in detail hereinafter, since tension in the cable is produced by pivoting the reel R, means is provided for monitoring the hydraulic pressure load on the cylinders which pivot the reel to determine the amount of tension in the cable C. Further, pressure release means is also provided as a safety device to prevent overloading the cable C.

Considering further the apparatus shown in FIG. 1 of the drawing, it will be seen that the boom B may be pivoted from a storage position indicated by B-1 and shown in phantom to an upright or working position with the cable taut as shown by the solid line C or with the cable slacked as shown by the dotted line C'. Also, it will be appreciated that the derrick floor F is shown schematically with the derrick legs that form the V door through which the cable passes not shown. The floor past P may be formed of a joint of drill collar or other suitable rigid member and normally extends through an opening in the derrick floor F. Such support post is free to rotate about its vertical axis so as to pivot the sheave S at the upper end into alignment with the cable C and thereby minimize scraping and wear on the cable and sheave.

The truck or vehicle V is any suitable truck for mounting the skid mounted unit H.

Figure 2:
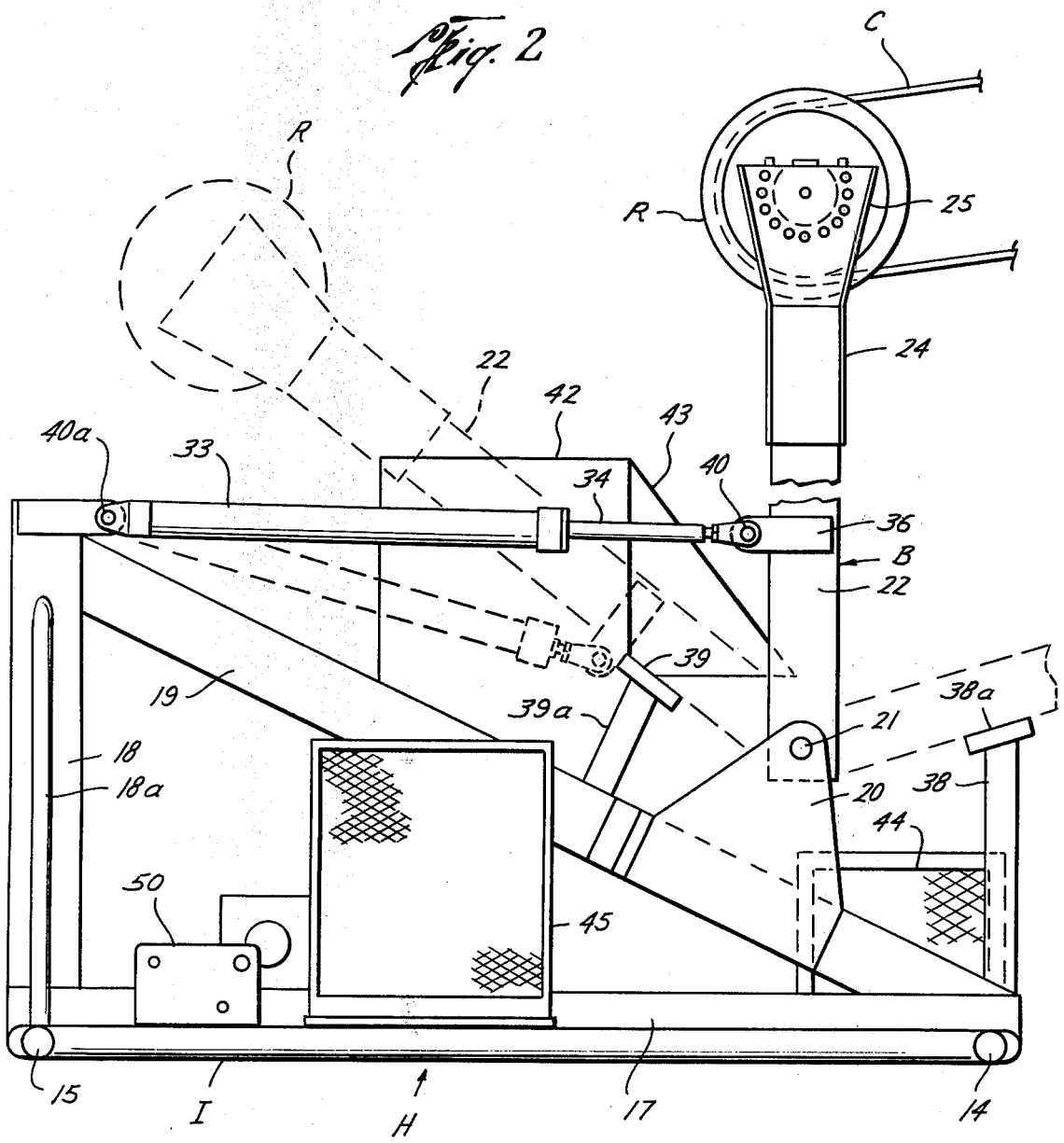
FIG. 2 is a side elevation showing the drum and boom in an operation position and in phantom in position for travel.
Figure 3:
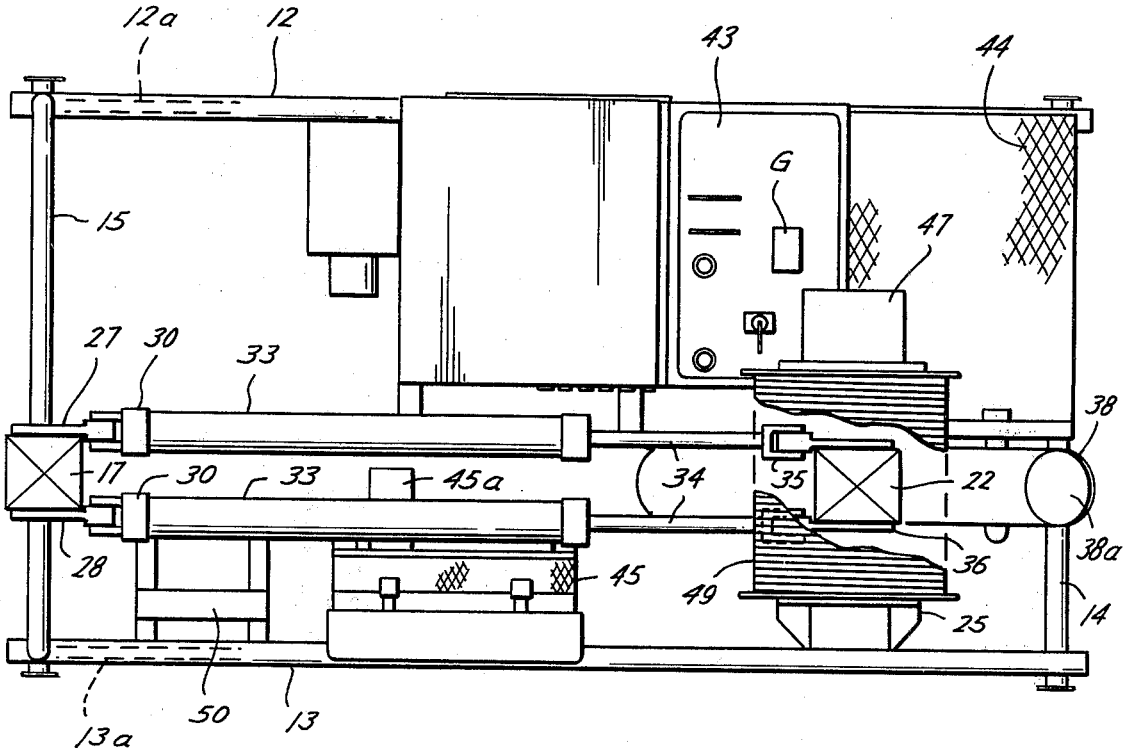
FIG. 3 is a top view showing the drum and boom.

Considering such skid mounted unit H now in more detail, as shown in FIGS. 2 and 3 of the drawings, the unit includes a rectangular perimeter frame or base consisting of parallel side members 12 and 13 and front and rear end members 14 and 15, respectively. Such frame members are preferably tubular members welded or otherwise secured together at their adjacent ends. An intermediate longitudinally extending base tube 17 is connected to front and rear end members 14 and 15 and is generally parallel to the side members 12 and 13, respectively. This base member is preferably a square tubular member having an extensible member **17*a*** telescopically mounted therein for a purpose to be described hereinafter.

Also as shown in FIGS. 2 and 3 of the drawings, the skid assembly includes a post 18 mounted vertically on the rear end of the base tube 17, such vertical post having diagonal side support members **18*a* extending diagonally downwardly and outwardly to the side members 12 and 13. The diagonal support beam 19 has its upper end connected at or near the top of the vertical support 18 and its lower end connected at the forward end of the base tube 17. The base tube 17, vertical post 18 and diagonal beam member 19** form a right triangle as shown in FIG. 2.

A bracket 20 is welded or otherwise secured on the diagonal beam 19 and is provided with suitable openings for receiving pivot pin 21 which pivotally mounts the lower end of the boom arm 22. The upper end of the boom arm carries a fork assembly 24 at its upper end which includes a pair of upwardly and outwardly extending arms 25 and 26 between which the rotatable drum R is mounted.

The support post 18 has a pair of ears 27 and 28 secured thereto and projecting forwardly for receiving the pinned ends 30 of a pair of hydraulic piston cylinders 33. Each of such cylinders includes a rod 34 which is secured to another pair of ears 36 which are welded or otherwise secured to the boom member 22. The rods 34 have forked ends 35 which have suitable openings for receiving pins 40 for providing a pinned and pivotable connection between the rods 34 and the boom 22. The rear or base of the cylinder 33 is pinned by pins **40*a* to the bracket 40*b* welded or otherwise secured to the upper end of the vertical post 18. It will be appreciated that a single cylinder is capable of pivoting the boom and that the boom may be thus operated while one cylinder is disconnected for repair of replacement. It will also be appreciated that the boom beam 22, the cylinder 33 and diagonal beam 19 form an upper triangle which is complimentary to the lower triangle formed by beam 19, the tube 17 and vertical post 18. When the boom 22** is in the vertical position shown in FIG. 2 the upper triangle is also a right triangle and is back-to-back with the lower triangle. This gives the pipe handling apparatus greater strength and stuctural rigidity.

The forward transverse member 14 is provided with a vertically upstanding post 38 which supports a pad **38*a* which provides a safety pad for engaging the boom 22 and limiting its fall or pivoting in a forward direction. Similarly, a travel support pad 39 is mounted on a support post 39*a* that is welded or otherwise suitably secured to the inclined support member 18. As shown in FIG. 2 of the drawing, when the skid assembly H is prepared to be moved, the pistons 33 are retracted to pivot the boom member 22 to the dotted line position with it resting against the travel support pad 39. Also, an operator's cab 42 is shown in the FIG. 2 drawing. Such cab includes an inclined windshield or window 43** adjacent the operator's seat in the cab to provide a view of the operation with the pipe handling device and also to provide a shelter or protected area for the operator.

Also shown in FIG. 3 is a storage basket or area 44 which is positioned in front of the operator's cab 42 and also an oil cooler assembly 45 which is connected to the hydraulic system to provide a means for cooling the hydraulic fluid used as the working fluid in the hydraulic motor and cylinder. Also, as shown in FIG. 3, the hydraulic motor 47 is positioned at one end of the drum R, and rotates about the same axis as the drum R. Further, as shown in the drawings, the exterior surface of the drum has a continuous helix groove 49 on which the cable C is rove. Such groove is provided for receiving the cable C as it is rove around the drum R, such cable is not fixedly secured to the drum, but rather grips the drum by friction. Multiple wraps of cable are rove on the groove drum to adjust the working length of the cable between the drum R and the sheave S. The continuous helix groove is of sufficient length to accommodate enough cable to frictionally engage the drum to move the object O from the skid assembly H to the sheave S at the derrick floor without the cable C being wrapped to form a second layer on top of the cable or the drum R. With this arrangement, objects may be moved to the sheave S or from the sheave S down to a point adjacent the skid mounted unit H with a single cable rove about a single drum with a single layer of cable on the drum. Also, the skid assembly H is provided with a suitable hydraulic power supply inlet panel or manifold 50 for receiving remote hydraulic power for operating the unit. As shown in FIG. 3, the cooler 45 is mounted in connection with a hydraulic motor **45*a*. Thus, with this arrangement, the self-contained hydraulic power supply may be used or a remote hydraulic power supply may be used, if desired. As shown in FIG. 1, the cable C extends through the trollies T which comprise upper and lower assemblies indicated as 50 and 51, each of which is made up of a pair of parallel side plates 53 and 54. The upper assembly 50 is provided with a pair of grooved rollers 55 having a circumferentially extending groove 56 therein for receiving the cable C. Such rollers are rotatably mounted on suitable bearings (not shown) carried by the threaded bolt 57 which are connected in the plates 58. An upper transverse spacer 59 is provided between the upper ends of the plates 53 and 54. At the lower end of the assembly 50, a hanger strap 52 is provided which secures the lower assembly 51 to the upper assembly 50. Also, the upper assembly is provided with laterally spaced connecting bolts 60 and 61 which extend through the plates 53 and 54 for securing the lower portion of the plates 53 and 54** together.

As shown in FIG. 1 of the drawings, the trollies T each have pipe support members which support the pipe or object O. As shown, the uppermost trolly T is provided with a J-shaped hook or strap 64 which extends downwardly from the lower assembly 51 and cradles the pipe O near its upper end. The lower trolly T is provided with a similar cradle member which extends beneath the pipe and which has a closed rear end portion 65 against which the lower end of the pipe or object O rests so that as the lower trolly T moves diagonally upwardly it forces the pipe or object O to move diagonally upwardly also. Further, the cable C is provided with a bumper member 66 which engages the lower assembly 51 of the lower trolly T and moves the trolly and the pipe diagonally upwardly as the drum R is rotated in a clockwise direction. It will be appreciated that when the pipe or object O reaches the desired position adjacent the derrick floor that rotation of the drum R can be stopped and the front trolly T-1 secured by the pole P by means of a soft line L. This is accomplished by someone on the drill floor grasping a line and wrapping it a turn around the pole P and then holding the line so as to hold the trolly T-1 adjacent the pole P. Thereafter, the pipe is connected to elevators or other suitable lifting means and lifted out of the hook 64 and vertically upwardly into the derrick D. The rear trolly T-2 is free to run on the cable C and thus can follow the lower end of the pipe P upwardly unit it is in a position adjacent the upper trolly T-1 which is held in position by the soft line wrapped around the pole P. It will also be appreciated that since both trollies T-1 and T-2 are free to travel relative to the cable C that the space between such trollies can be adjusted to accommodate the length of the object O.

Similarly, it will be appreciated that the trollies T-1 and T-2 can move the pipe downwardly from a position adjacent the derrick floor F to the pipe racks W by rotating the drum R in a counterclockwise direction and then lowering the boom B.

Figure 4:
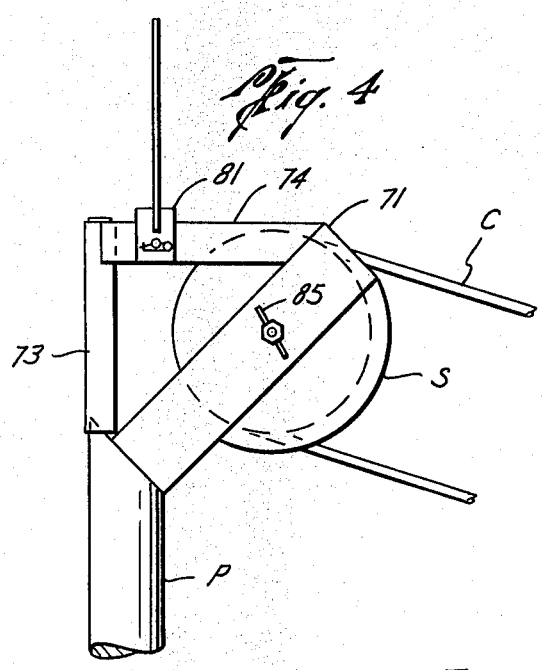
FIG. 4 is a side elevation showing the sheave support.
Figure 5:
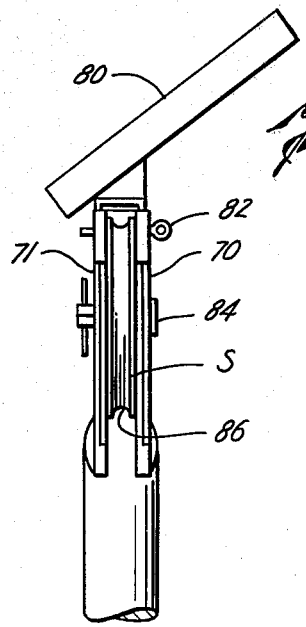
FIG. 5 is a front elevation of the sheave support.
Figure 6:
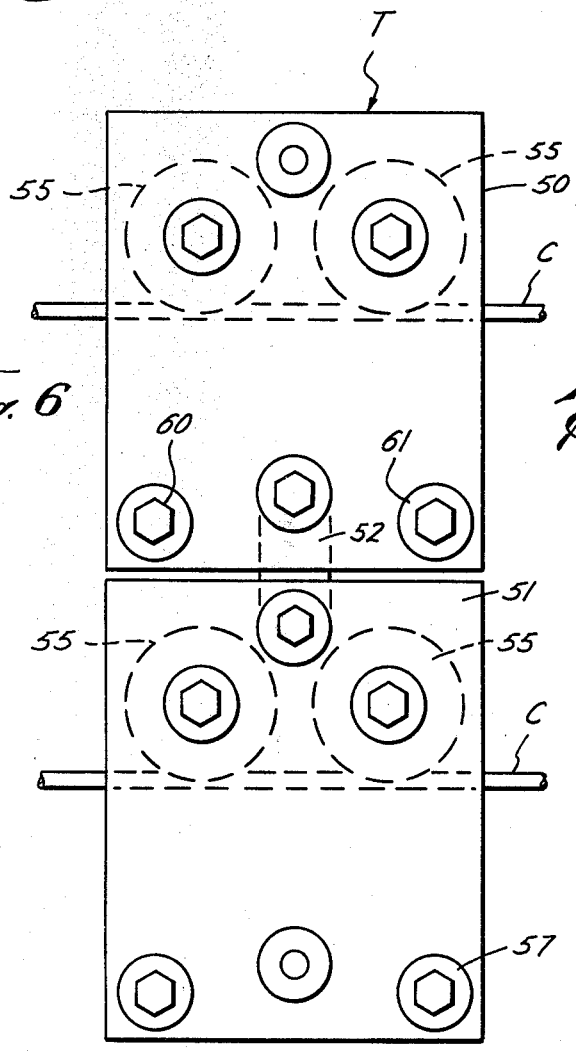
FIG. 6 is a side elevation of the trolly of the present invention.
Figure 7:
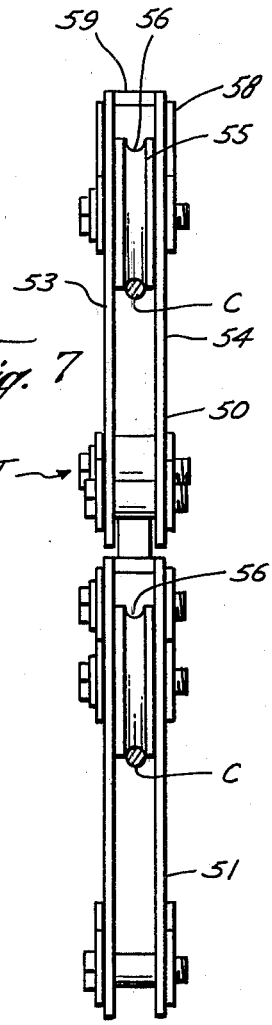
FIG. 7 is a front elevation of the trolly.

As shown in FIGS. 4 and 5 of the drawing, the sheave S which is positioned at the top of the derrick floor pole P is mounted in a generally vertical position between the parallel side plates 70 and 71 which are disposed in an angular position relative to the pipe P. The vertical plate 73 extends upwardly from the top of the pole P and is welded or otherwise secured to a generally horizontal plate 74 which is welded to the upper outer end of the side plates 71 and 70. An inclined guide bar 80 is welded to a bracket member 81 that is secured by a pin 82 to the upper channel 74. Such guide bar 80 is provided for engaging a joint of pipe being lowered from the derrick to the cradle members 60 and 61 to facilitate positioning a joint of pipe in the cradles for lowering to the pipe rack W. It will be appreciated that the inclined guide 80 may be positioned facing to either side of the cable C depending upon which way the cradle members 60 and 61 are turned, which will depend on which side of the cable the pipe rack W is positioned. Also, the sheave S is rotatably mounted on the pin 84 which has a wing nut 85 that is threaded onto the end of the pin to provide a quick release mechanism whereby the pin 84 can be quickly and easily removed to facilitate rigging up and rigging down. Simply by removing the pin the sheave S may be dropped out of its support brackets 70 and 71 and the cable C removed from groove 86 in the sheave S. The groove 86 is a deep groove and the sides of the sheave **86*a* and 86*b*** are flared outwardly to facilitate entry and exit of the cable C from the sheave with a minimum of scraping or wear on the cable.

In operation, the skid assembly H is moved onto location and positioned at the desired location relative to the derrick floor F on the side of the V door and the sheave support pole P is positioned near the V door extending through a suitable opening in the floor F and secured so as to remain in a substantially upright position. However, it will be appreciated that the pole P is free to rotate through a sufficient arc to provide a fair lead for the sheave S and permit it to pivot with the cable C as the point at which the cable leaves the reel R moves transversely of the drum. The pivotal movement of the pole P enables the sheave S to act as a fair lead and prevents or minimizes scraping of the cable C as it moves into and out of the groove 86 of such sheave S.

While the portable skid assembly H is being moved onto the location and from place to place, the drum R is lowered to the position shown in dotted lines in FIG. 2 with the boom 22 inclined and resting against the support pad 39 and the hydraulic cylinders in their retracted position also shown in dotted lines in FIG. 2.

When desired, the hydraulic cylinders are actuated and the rods 34 extended from the cylinders 33 and the beam 22 is pivoted about the pin 21 to an upright position for transporting pipe or other objects to or from the derrick floor and, such beam 22 may be pivoted forwardly to slack the cable C and move it to the position indicated by dotted lines C'. Also, as shown in FIG. 2, a support pad **38*a* is provided to limit the downward travel of the beam 22**.

The cable C is rove about the reel or drum R in the helix groove 49 with the diameter and the length of the drum being of such ratio to provide sufficient groove length for the cable to transverse from the drum to the rig floor or from the rig floor down to the drum without requiring a second layer of cable on the drum. The continuous helix groove in the drum provides a means for roving the cable on the drum without adjacent turns of the cable contacting each other to thereby reduce wearing of the cable during operation. With this arrangement, a constant amount of cable is coming onto the drum as that which is leaving the drum and that permits the drum to be maintained in a fixed position as the trollies T are moved toward the rig floor or back toward the skid assembly H.

It will be appreciated that tension in the endless cable C is controlled by extending and retracting the hydraulic cylinders 33 which cause the drum or reel R to move in an arcuate path to provide slack in the cable C as the center distance between the drum and the floor sheave S is reduced and also to tension the cable C as the center distance between the floor sheave S and the center of the drum R is increased. This slackening and tensioning of the cable provides vertical movement of the travelling blocks or trollies T and permits the cable C to move from the position shown in solid lines in FIG. 1 to the position shown in the dotted line or any intermediate position therebetween. In the normal operating position, the boom B is in a vertical position and it travels generally in the line of the tangent to its arc so that when it is lowered to slack the line there is substantially more horizontal movement than there is vertical movement by the drum R.

In rigging up, the pipe handling apparatus is aligned with the V door and the cable C is taken to the sheave S, rove around the sheave and returned to a position near the drum where the two ends of the endless cable are connected together with the trollies positioned ahead of the bumper. A number of turns can be rove onto the drum R to accommodate a portion of the cable C, if that should be necessary due to the spacing requirements between the drum and the sheave S. Also, when it is desired to rig down the apparatus of this invention, the endless cable is disconnected at the bumper and one end is temporarily connected to the drum R which is then rotated to wind the cable on the drum for storage and transportation in the down position shown in dotted line in FIG. 2. The trollies T-1 and T-2 may be carried in the basket 44 adjacent the front of the cab 42.

The hydraulic power to move the cylinders 33 may be provided by a self-contained hydraulic pump (not shown) that is mounted with the skid assembly H, such pump being operated either by electric motor or an engine driven means. Alternatively, external hydraulic power such as hydraulic power from a rig source or trailer mounted or other remote hydraulic power source may be connected through the manifold 50 and used to operate the cylinders 33 and motor 47.

As indicated above, tension in the cable C is produced by the load imposed on the trollies T and by the drum R and such load is a function of the angle formed by the tensioned cable C between the two points of suspension, namely the floor pole sheave S and the drum R. As this angle approaches 180°, the forces created by a given load approach infinity. For this reason, it is important to be able to measure the amount of tension in the cable and thus be able to control the tension within safe limits. A hydraulic sensor means is provided for sensing the amount of hydraulic pressure in the loaded end of the cylinders 33 to provide a measure of the amount of tension in the cable C. A gauge G is positioned in the cab in view of the operator so as to provide a visual indication of the pressure load so that he can determine the amount of tension in the cable C. Also, a direct acting relief valve is provided in the hydraulic lines which will relieve at a predetermined pressure so as to discharge or exhaust hydraulic fluid from the rod end of the cylinder 33 is a gradual manner as excess loading is applied to prevent overloading of the cable C. As the hydraulic fluid is vented from the rod end of the cylinder 33, the cable C begins to slacken and provide a second indication that the cable is being overloaded in addition to the indication on the gauge G. As a further safety measure, as the drum head R moves downwardly in its arc shaped path of travel, it provides slack in the cable C and thereby increases the angle at the point of loading by the trollies T and thereby increases the cable's ability to carry the suspended load. The hydraulic relief valve on the cylinders 33 provides an automatic load limiting and load compensating means to protect the cable and the operation from accidential overloading.

The foregoing disclosure and description of the invention are illustrative and explanatory thereof, and various changes in the size, shape and materials as well as in the details of the illustrated construction may be made without departing from the spirit and scope of the invention.

I claim:

1. An apparatus for lifting and/or lowering heavy objects and transporting them laterally comprising:

(a) a rigid frame assembly having a boom pivotally mounted thereon;

(b) a rotatable drum carried by said boom and having a helical groove therein for receiving an endless cable loop rove around the drum for frictionally gripping same but not fixedly secured thereto;

(c) a pivotally mounted rotatable sheave for receiving a loop of said endless cable;

(d) a helical groove in said rotatable drum having a sufficient length to receive a length of cable equal to the distance between such drum and said pivotally mounted sheave with a single layer of cable wrapped thereon; and (e) hydraulic cylinder means operably connected to said pivotally mounted boom for pivoting said boom and moving said rotatable drum through an arc whereby an endless cable rove on the drum and over the pivotally mounted sheave will be slackened or tensioned by pivotal movement of the boom mounted rotatable drum.

2. The invention of claim 1, including a trolly means having upper and lower roller assemblies with support means for securing such upper and lower assemblies together and means for connecting a joint of pipe to said trolly means.

3. The invention of claim 2, wherein said trolly means have a plurality of rollers in said upper and said lower roller assemblies for engaging said endless cable.

4. The invention of claim 1, including means on said cable for engaging one of said trolly members for moving such trolly member with said cable.

5. The invention of claim 1, including hydraulic pressure sensing means with said hydraulic actuator and hydraulic pressure indicating means for indicating such hydraulic pressure.

6. The invention of claim 1, including hydraulic pressure relief valve means for relieving hydraulic pressure from said hydraulic actuating means when said pressure exceeds a predetermined amount.

7. The invention of claim 1, wherein said hydraulic actuator includes relief valve means for relieving hydraulic pressure when the load on said cable exceeds a predetermined amount.

* * * * *